United States Patent [19]

Graham et al.

[11] 4,421,564

[45] Dec. 20, 1983

[54] HEAT COAGULABLE PAPER COATING COMPOSITION WITH A SOY PROTEIN ADHESIVE BINDER

[75] Inventors: Paul M. Graham, Ballwin, Mo.; Thomas L. Krinski, Granite City, Ill.

[73] Assignee: Ralston Purina Company, St. Louis, Mo.

[21] Appl. No.: 368,190

[22] Filed: Apr. 14, 1982

[51] Int. Cl.[3] ..... C08L 89/00; A23J 1/12

[52] U.S. Cl. ..... 106/154 R; 260/123.5

[58] Field of Search ..... 260/123.5; 106/124, 106/146, 147, 154

[56] References Cited

U.S. PATENT DOCUMENTS

| | | | |
|---|---|---|---|
| 2,410,382 | 10/1946 | Kaplan | 106/146 |
| 2,849,334 | 8/1958 | Hart | 117/64 |
| 2,950,214 | 8/1960 | Smith | 117/64 |
| 3,081,182 | 3/1963 | Mahoney | 106/146 |
| 3,261,822 | 7/1966 | Robbins | 260/123.5 |
| 3,356,517 | 12/1967 | Nakajima et al. | 106/148 |

*Primary Examiner*—Theodore Morris

*Attorney, Agent, or Firm*—Virgil B. Hill

[57] ABSTRACT

A method of producing a paper coating composition containing a soy protein adhesive binder which is thermally sensitive or coagulates with heating is described wherein a soy protein isolate is solubiized to form a proteinaceous adhesive binder, said binder is mixed with a mineral pigment to provide a slurry having a solids level of at least about 63% by weight of the slurry, followed by control of the pH of the slurry to between about 5.7 to 6.2 and the addition of a salt selected from the group consisting of Zinc Acetate and Zinc Formate in amounts effective to cause heat coagulation of said slurry upon heating thereof. The coating is particularly used in cast coating processes, involving the application of heat to achieve uniform smoothness of the applied coating on paper.

24 Claims, No Drawings

HEAT COAGULABLE PAPER COATING COMPOSITION WITH A SOY PROTEIN ADHESIVE BINDER

BACKGROUND OF THE INVENTION

This invention relates to a method of producing a paper coating composition which is sufficiently fluid at ambient temperatures for ease of coating but coagulates upon the application of heat to provide a uniform moldable coating which yields a high quality finish for cast coated paper.

Conventional paper coating includes the use of a mineral pigment as the primary component of a paper coating composition to provide a high quality finish for paper products. A typical component of the pigment containing coating includes a proteinaceous binder for adhesion of the mineral pigment to the paper surface. Isolated soy protein has successfully filled this need and is a commonly used adhesive binder for paper coating compositions containing mineral pigments.

There are certain types of high quality coated papers however which are coated by specific coating techniques which require the use of a coating composition that is relatively fluid at ambient temperatures or typical temperatures of coating but which coagulate upon the application of heat to provide a coating with a high quality gloss and uniform finish. While the present invention is not intended to be limited by specific types of paper coating techniques for which the coating composition of the present invention is suitable, nevertheless, the coating containing the binder is particularly well suited for the cast coating of paper. This method which is specifically described in U.S. Pat. No. 1,719,166 generally employs a heated surface against which the rewetted coated paper is pressed until dry. The coagulated coating is softened by the application of boiling water as the coated paper comes into contact with a heated polished drum surface. This resoftening of the coating allows the surface of the coated paper to conform to the polished drum. The heated surface usually conists of a highly polished nickel or chromium roller having a smooth unblemished surface. Drying of the coated paper in this way permits the coating to take on the finish of the drying roll surface, making it possible to obtain a uniformly high gloss finish as long as the surface of the dryer roll remains unmarred.

The usefulness of such a coating process and the quality of coating obtained thereby is greatly improved by the use of a coating which is relatively easy to apply at the temperature of coating but coagulates or thickens upon the application of heat to provide a high quality coating at the moment of heating thereby maximizing the finish and quality of the coating composition.

U.S. Pat. No. 3,356,517 describes a process for the production of a paper coating composition which is operable in a cast coating process by the formation of a coating which is coagulable upon the application of heat. A mineral pigment, a dispersing or suspending agent, a mineral acid or salt thereof, and a proteinaceous adhesive binder provide a coating which heat flocculates at a temperature of 35° to 90° C. It is indicated in this reference that either soy protein or casein may be employed as the adhesive binder for the pigment containing coating.

In spite of the above described disclosure for the production of heat coagulable coatings with either casein or soy protein as an adhesive binder, the use of soy protein binders in such coatings has been extremely inconsistent and not totally reproducible. A need therefore exists for the production of heat coagulable paper coatings containing soy protein as a binder which is consistently reproducible and usable on a commercial basis.

It is therefore an object of the present invention to provide a process for producing a heat coagulable coating composition having a soy protein adhesive binder which consistently coagulates upon the application of heat to provide a uniform coating.

It is a further object to provide a process for producing a heat coagulable paper coating and with a soy protein adhesive binder which is particularly well suited for use in a cast coating process for paper.

These and other objects are accomplished by the present invention as described below.

SUMMARY OF THE INVENTION

The use of paper coating processes employing heat to finish the coating such as cast coating, was found to have unique problems when soy protein was employed as the proteinaceous adhesive binder in coating compositions employed in processes of this type. It was found that the use of soy protein adhesive binders in heat coagulable paper coatings such as are employed in cast coatings, require a certain critical set of conditions relative to preparation of the coating composition to provide consistent coagulation of the coating upon the application of heat. These critical conditions include among other items control of the pH of the coating composition and selection of a very specific type of salt additive for the coating in order to create consistent heat flocculation or coagulation of the coating containing the soy protein binder and the mineral pigment.

An improved process for producing a heat coagulable paper coating composition containing a soy protein adhesive binder is provided for in the present invention comprising: solubilizing a soy protein isolate at a pH of about 6.2 to 7.0 to form a proteinaceous adhesive binder for the coating; mixing or blending said adhesive binder with a mineral pigment to provide a slurry having a solids level of at least about 36% by weight of said slurry; controlling the pH of the slurry to between about 5.7 to 6.2 and adding to said slurry a salt selected from the group consisting of zinc acetate and zinc formate in an amount effective to cause coagulation or thickening of said slurry upon heating thereof.

Control of the pH of the slurry comprising the paper coating composition together with the addition of a specific salt selected from either zinc acetate or zinc formate have been determined as the critical factors in producing a paper coating composition having soy protein as an adhesive binder that will coagulate upon the application of heat and function reliably in a paper coating operation particularly that employing cast coating. Why these exact salts function so well and at the noted pH range is not entirely understood but the improvement in rheological properties of the coating composition with these materials is pronounced even as compared to other closely related salts such as calcium acetate, sodium acetate, zinc chloride, or calcium formate.

DESCRIPTION OF THE PREFERRED EMBODIMENTS

Preparation of the coating composition of the present invention involves initial preparation of a protein adhesive binder solution followed by preparation of the coating composition containing both the binder and a mineral pigment as the major components of the coating composition.

The proteinaceous adhesive binder employed in the present invention is soy protein isolate derived from defatted soybean flakes. Basically, isolated soy protein is produced by extraction of the protein from defatted soy flakes in an aqueous medium varying in pH from near neutrality to a highly alkaline pH depending upon the type of isolate desired. After extraction, the protein containing liquor is separated from the spent residue and treated with an acidic reagent to precipitate the soy protein at its isoelectric point. The resulting protein curd is then separated from the aqueous liquor, washed, dried and ground to the desired size. The dried purified protein can be readily resolubilized with various alkaline materials for the preparation of a proteinaceous adhesive binder solution.

The particular type of soy protein isolate which may be employed in the present invention is not critical to its practice although typically a hydrolyzed or modified soy protein isolate should be employed. Typically, a hydrolyzed or modified protein isolate is produced by treatment of the extracted curd with alkaline reagents such as sodium or ammonium hydroxide, or other modifying agents under controlled conditions of pH, temperature, and time to dissociate and unfold the complex protein structure into smaller but heterogeneous units. This treatment rsults in the formation of a protein curd which has been essentially modified from its native state.

A soy protein isolate is initially solubilized in an aqueous medium at a pH of from about 6.2 to 7.0 to form a solution of the soy protein isolate. The exact pH range which may be employed is not critical to the practice of the present invention and it is further not critical as the exact material that is employed to solubilize the soy protein at the noted pH. Typical solubilizing agents for soy protein include alkaline substances such as sodium carbonate, ammonium hydroxide, sodium hydroxide and the like. These substances represent conventional means of solubilizing soy protein isolate for use as an adhesive binder in paper coating compositions. The amount of soy protein isolate used to prepare the protein adhesive binder solution is at a level sufficient to form an adhesive binder for the pigment coating and typically of a sufficient level so that when the coating composition with the mineral pigment is prepared about 8 to 15% by weight of the coating comprises binder.

It is further desirable to employ in the present invention fluidizers or thinning agents in preparation of the soy protein binder solution. This improves the ultimate viscosity of coating compositions which are prepared with the protein binder solution. Typical fluidizers include materials such as dicyandiamide, ammonium nitrate or urea. These fluidizing agents may be employed in the preparation of the protein binder solution of the present invention and are added in amounts of between about 5 to 35%, preferably 15 to 25% by weight of the soy protein isolate used to prepare the binder. It is preferred in the present invention that a combination of dicyandiamide and ammonium nitrate be employed as fluidizing agents, and be added during preparation of the binder solution. This not only improves the ultimate viscosity of the coating but reduces the amount of alkali needed to solubilize the protein. It is preferred although not essential that equal amounts of both dicyandiamide and ammonium nitrate be employed to achieve the level of fluidizing agent needed for viscosity control of the coating composition.

The soy protein isolate is initially dispersed in water at an elevated temperature preferably about 65° C. and 15 to 25% by weight of fluidizing agent based on the level of soy protein isolate used to prepare the binder is dissolved in the protein dispersion and mixed for a short period of time. Following this, the pH of the protein slurry is then adjusted to between about 6.2 to 7.0 by the addition of an alkali such as sodium or ammonium hydroxide to solubilize the soy protein isolate. It is desirable although not essential at this point to add a small percentage of a mineral pigment which improves the rheological properties of the protein binder solution for use in preparation of the coating composition. The solubilized soy protein isolate is then briefly mixed at an elevated temperature for a period of time such that the isolate is solubilized with the final pH of the proteinaceous adhesive binder solution being between about 6.2 to 7.0.

The coating composition employed in the present invention which is coagulable in the presence of heat and particularly suitable in paper coating processes such as cast coating is prepared by mixing the adhesive binder solution with a mineral pigment to provide a slurry having a solids content of at least about 36% by weight of said slurry, typically between about 38% and 44% by weight of said slurry and preferably between about 40% to 42% by weight of the slurry. The exact pigment which may be employed in preparation of the coating composition of the present invention is not critical and a variety of mineral pigments commonly used in the preparation of paper coatings may be employed including various types of clay, calcium carbonate, titanium dioxide and the like. Typical amounts of the mineral pigment which are employed in preparing the coating composition of the present invention are between about 28 to 32% by weight of the slurry and constitute the principle ingredient for control of the solids level in the coating composition of the present invention. Following dispersion of the mineral pigment with the proteinaceous adhesive binder solution the pH of the slurry is controlled to a critically defined level of between about 5.7 to 6.2 for production of a coating composition which is heat coagulable within the context of the present invention. The pH of the slurry prior to any adjustment will in great part be influenced by the pH of the binder solution and the affect of the mineral pigment on the pH of the slurry. The addition of acid or alkali either preceding or commensurate with the addition of a salt may be employed to control the pH to the desired range. A preferred alternative is simply to avoid the addition of acid or alkali, since the acid salt or solution thereof hereafter described will usually have an acidic pH and the addition of the salt will usually be sufficient to control the pH to the desired range. Either commensurate with or following control of the pH of the slurry, a specific type of salt is added to the slurry preferably in the form of a solution of the salt. The added salt is selected from the group consisting of zinc acetate and zinc formate. This salt is added to the coating composition in an amount effective to cause heat coagulation of the coating composition upon heating thereof and typically comprises between 5 to 15% by weight of the soy protein isolate in coating composition, preferably 7.5 to 12.5% by weight. The exact salt added as well as the pH of the coating composition is critical to the practice of the present invention and results in a coating composition which has consistently reproducible heat coagulable properties at temperatures of from 40° to 60° C. The use of this pH range and a very specific added salt produces a coating which is highly suitable for use in coating processes which require heat coagulation of the coating. It is also possible if desired to add other conventional additives employed in paper coating compositions without seriously altering the rheological properties of the coating of the present invention. Included within this group of materials are optical brighteners and co-binders such as acrylic or styrene—butadiene latexes.

The coagulation or flocculation of the slurry which takes place at the noted temperature range of 40° to 60° C. is entirely reversible and cooling of the coating composition results in a noticeable thinning or reduction in viscosity of the slurry so that the coating becomes fluid at ambient conditions. This facilitates use of the coating composition of the present invention in various paper coating processes since the slurry has relatively low viscosity at ambient conditions yet thickens and produces a uniform and consistent flocculation or coagulation of the mineral pigment and protein on the paper upon application of heat.

The following Examples represent specific but non-limiting embodiments of the present invention.

EXAMPLE 1

A heat coagulable paper coating composition containing a soy protein adhesive binder is prepared according to the present invention by initial preparation of the proteinaceous adhesive binder solution.

18.5 parts by weight of a soy protein isolate, identified as Purina Polymer 8000, available from Ralston Purina Company, St. Louis, Missouri is added to 69.5 parts of water with stirring at a temperature of 65° C. 1.8 parts of ammonium nitrate and 1.8 parts of dicyandiamide, as fluidizing or thinning agents are then dissolved in the protein dispersion and mixed for about 2 minutes to insure solubilization of the two fluidizing agents. 7.2 parts of calcined clay is then added to the slurry until uniformly dispersed. The protein is solubilized by the addition of 0.7 parts of 50% sodium hydroxide solution and 0.4 parts of concentrated ammonium hydroxide. The solution is mixed at 65° C. for approximately 25 minutes and the solution has a pH of 6.2.

A paper coating composition is then prepared by initial formation of an aqueous slurry of a mineral pigment, specifically kaolin coating clay containing 70% by weight kaolin. 44.3 parts by weight of the slurry containing 70% of kaolin is then combined with 21.5 parts of the proteinaceous adhesive binder solution prepared with soy protein isolate as described above. The slurry containing the mineral pigment and protein adhesive binder was cooled to about 75° F., and constant agitation was maintained to keep the pigment particles in suspension.

Following this, 2.3 parts of a solution containing 9% by weight zinc acetate is slowly added to the coating and the pH is measured and judged to be 5.75. Once the viscosity of the coating is constant, 7.8 parts of a 50% styrene-butadiene latex is combined in the formulation. Throughout the process of blending the salt and latex, 24.1 parts of water are added on a continuous basis in order to maintain a workable coating. The solids content of the slurry is measured as 41% by weight. The viscosity of the slurry at ambient temperature is measured at 250 cps, at 100 rmp with a Brookfield RVT Viscometer.

The viscosity of the coating is evaluated at 70° F. at a number of different solids levels and these various viscosity readings are set forth in Table 1.

TABLE 1

Effect of % solids on coating viscosity

| % Solids | Viscosity (cps) 100 r.p.m. Brookfield RVT Viscometer |
|---|---|
| 42 | 1100 |
| 41 | 450 |
| 40 | 240 |
| 39 | 220 |
| 38 | 180 |
| 37 | 165 |
| 36 | 145 |

It may be seen that the viscosity of the coating will increase dramatically above 41% solids.

Further rheological evaluation of the coating is made by looking at the relationship of pH and pre-coagulation temperature of the coating. The coating is adjusted to 40% solids, heated to various temperatures and the pH lowered or raised with either sodium hydroxide or acetic acid. The evaluation of the coating is set forth in Table 2.

TABLE 2

Effect of pH and Pre-Coagulation Temperature
Viscosity of Coating
Viscosity Readings (CPS) 100 r.p.m.
Brookfield RVT Viscometer

| Temp °F. | pH 5.5 | 5.7 | 5.87 | 6.0 |
|---|---|---|---|---|
| 60 | 300 | 200 | 180 | 65 |
| 70 | 400 | 250 | 200 | 95 |
| 80 | 560 | 435 | 260 | 130 |
| 90 | 960 | 540 | 460 | 230 |
| 100 | 2200 | 970 | 860 | 420 |
| 110 | — | 1800 | 1200 | 650 |
| 120 | — | — | — | 985 |

The above readings illustrate the critical nature of the pH range of the coating of the present invention since at lower pH's the coating becomes much too thick at somewhat higher coating temperatures, whereas at a pH higher than 6.0, the coating would not thicken at all even at temperatures of coagulation-(40°-60° C.).

The coating with the proteinaceous adhesive binder is then evaluated in the preparation of coated sheets by a cast coating process in general as described in U.S. Pat. No. 1,719,166. A number of sheets of paper are coated and the coating coagulated at 60° C. by contact with a heated surface. The average coated weight, the average brightness measured by method T452, of the *Technical Association of Pulp and Paper Industries* (TAPPI), average color as measured on a Hunter Colorimeter and average IGT pick strength are set forth in Table 3.

TABLE 3

| Avg. Coating wt, g/m² | Avg. Brightness (%) | Color Measured on Hunter Colorimeter Scale L | a | b | Coating Pick | Avg. Gloss (%) |
|---|---|---|---|---|---|---|
| 19.9 | 81.0 | 92.9 | −.05 | +4.2 | Acceptable | 91.9 |

The coating functions very satisfactory and coagulates consistently at the noted temperature of 60° C. to provide a uniform and high quality coating for the sheets.

EXAMPLE 2

The importance of using the specific salts set forth in the present invention for production of a heat coagulable coating with the soy protein adhesive binder is illustrated by the following work.

The proteinaceous adhesive binder solution is prepared as described in Example 1 and the coating composition is produced in the same manner as Example 1 except the salts and amounts listed below were substituted for zinc acetate in preparation in the coating composition. These results are set forth in Table 4 together with an evaluation of the effect of the salt on the coating composition in terms of heat coagulability at 40°-60° C.

TABLE 4

| Salt | Amount Added to Slurry | pH of Coating | Comments |
|---|---|---|---|
| Calcium Formate | 3 parts | 5.8 | No heat sensitivity, would not coagulate with heat |
| Zinc Chloride | 0.7 | 5.9 | Slurry thickened, but no coagulation with heat |
| Zinc Chloride/ Aluminum Sulfate | 0.7 | 5.9 | Became thicker but no coagulation with heat |
| Calcium Acetate | 0.7 | 5.8 | No coagulation with heat |
| Sodium Acetate | 0.7 | 5.8 | No coagulation with heat |
| Zinc Formate | 1.0 | 6.0 | Gelled, and coagulated with heat |

It can be seen from the above data that closely related salts added to the coating composition prepared with the soy protein adhesive binder did not adequately coagulate as compared to the zinc acetate used in Example 1. Zinc formate is the only salt that produced a somewhat comparable heat coagulating effect as compared to the zinc acetate used in Example 1.

While the present invention has been described with regard to the specific embodiments set forth above, it should be understood that it is intended to include within the scope of the present invention all reasonable or equivalent variations thereof.

What is claimed is:

1. A process for producing a heat coagulable paper coating composition containing a soy protein adhesive binder comprising:

(a) solubilizing a soy protein isolate to form a proteinaceous adhesive binder for said coating;

(b) mixing said adhesive binder with a mineral pigment to provide a slurry having a solids level of at least about 36% by weight of said slurry, (c) controlling the pH of the slurry to between about 5.7 to 6.2 and adding to said slurry a material consisting essentially of a salt selected from the group consisting of Zinc Acetate and Zinc Formate in an amount effective to cause heat coagulation of said slurry at a temperature of 40°-60° C. upon heating thereof.

2. The process of claim 1 wherein the soy protein isolate is solubilized at a pH of 6.2 to 7.0.

3. The process of claim 1 wherein a fluidizing agent is added during solubilization of the soy protein isolate.

4. The process of claim 3 wherein the fluidizing agent is added in an amount of 5 to 35% by weight of the soy protein isolate.

5. The process of claim 4 wherein the fluidizing agent is added in an amount of 15-25% by weight of the soy protein isolate.

6. The process of claim 1 wherein the fluidizing agent is selected from the group consisting of dicyandiamide, ammonium nitrate, and mixtures thereof.

7. The process of claim 6 wherein the mixture comprises equal amounts by weight of dicyandiamide and ammonium nitrate.

8. The process of claim 1 wherein said slurry has a solids content of 36 to 44% by weight.

9. The process of claim 1 wherein said mineral pigment is added in an amount of 28 to 32% by weight of the slurry.

10. The process of claim 1 wherein pH control is achieved commensurate with the addition of the salt.

11. The process of claim 1 wherein the amount of salt added is between about 5-15% by weight of the soy protein isolate.

12. The process of claim 11 wherein the amount of salt added is between 7.5 to 12.5% by weight of the soy protein isolate.

13. A process for producing a heat coagulable paper coating composition containing a soy protein adhesive binder comprising:

(a) solubilizing a soy protein isolate at a pH of 6.2 to 7.0 to form a proteinaceous adhesive binder for said coating;

(b) mixing said adhesive binder with a mineral pigment to provide a slurry having a solids level of between about 36 to 44% by weight of said slurry, (c) controlling the pH of the slurry to betweeen about 5.7 to 6.2 and adding to said slurry a material consisting essentially of a salt selected from the group consisting of Zinc Acetate and Zinc Formate in an amount effective to cause heat coagulation of said slurry at a temperature of 40°-60° C. upon heating thereof.

14. The process of claim 13 wherein a fluidizing agent is added during solubilization of the soy protein isolate.

15. The process of claim 14 wherein the fluidizing agent is added in an amount of 5 to 35% by weight of the soy protein isolate.

16. The process of claim 15 wherein the fluidizing agent is added in an amount of 15-25% by weight of the soy protein isolate.

17. The process of claim 13 wherein the fluidizing agent is selected from the group consisting of dicyandiamide, ammonium nitrate, and mixtures thereof.

18. The process of claim 17 wherein the mixture comprises equal amounts by weight of dicyandiamide and ammonium nitrate.

19. The process of claim 13 wherein the salt is added to said slurry in an amount of 5 to 15% by weight of the soy protein isolate.

20. The process of claim 19 wherein the salt is added to said slurry in an amount of 7.5–12.5% by weight of the soy protein isolate.

21. A process for producing a heat coagulable paper coating composition containing a soy protein adhesive binder comprising:

(a) solubilizing a soy protein isolate at a pH of 6.2 to 7.0 to form a proteinaceous adhesive binder for said coating;

(b) mixing said adhesive binder with a mineral pigment to provide a slurry having a solids level of between about 36 to 44% by weight of the slurry, (c) controlling the pH of the slurry to between about 5.7 to 6.2 and adding to said slurry a material consisting essentially of a salt selected from the group consisting of Zinc Acetate and Zinc Formate in an amount of about 5 to 15% by weight of the soy protein isolate to cause heat coagulation of said slurry at a temperature of 40°–60° C. upon heating.

22. The process of claim 21 wherein a fluidizing agent selected from the group consisting of dicyandiamide, ammonium nitrate and mixtures thereof is added during solubilization of the soy protein isolate.

23. The process of claim 22 wherein the mixture comprises equal amounts by weight of dicyandiamide and ammonium nitrate.

24. The process of claim 21 wherein the salt is added in an amount of between about 7.5–12.5% by weight of the soy protein isolate.

* * * * *